US010575595B2

(12) United States Patent
Dealey et al.

(10) Patent No.: US 10,575,595 B2
(45) Date of Patent: Mar. 3, 2020

(54) ADJUSTABLE JIG

(71) Applicant: NIKE, Inc., Beaverton, OR (US)

(72) Inventors: Stuart W. Dealey, Portland, OR (US); Nicolai M. Luksza, Austin, TX (US)

(73) Assignee: NIKE, Inc., Beaverton, OR (US)

( * ) Notice: Subject to any disclaimer, the term of this patent is extended or adjusted under 35 U.S.C. 154(b) by 351 days.

(21) Appl. No.: 15/360,210

(22) Filed: Nov. 23, 2016

(65) Prior Publication Data

US 2018/0140054 A1 May 24, 2018

(51) Int. Cl.

| | |
|---|---|
| ***A43D 11/00*** | (2006.01) |
| ***A43D 8/00*** | (2006.01) |
| ***B25B 11/00*** | (2006.01) |
| ***A43B 1/04*** | (2006.01) |
| ***A43B 23/02*** | (2006.01) |

(52) U.S. Cl.

CPC ..... *A43D 11/00* (2013.01); *A43B 1/04* (2013.01); *A43B 23/0205* (2013.01); *A43D 8/00* (2013.01); *B25B 11/00* (2013.01)

(58) Field of Classification Search

CPC . A43D 11/00; A43D 8/00; A43D 8/12; A43D 8/28; B25B 11/00; B25B 11/02; B23Q 3/00; B23Q 3/02; B23Q 3/06; B23Q 3/069

USPC ..... 29/281.1; 269/58, 77, 289 R, 309, 311, 269/900, 56

See application file for complete search history.

(56) References Cited

U.S. PATENT DOCUMENTS

| | | | | |
|---|---|---|---|---|
| 1,665,099 A | | 4/1928 | Kiesling et al. | |
| 3,316,573 A | * | 5/1967 | Chaplick | A43D 11/00 12/146 D |
| 3,397,418 A | | 8/1968 | Steadman et al. | |
| 3,837,025 A | | 9/1974 | Lockwood et al. | |
| 4,291,869 A | | 9/1981 | Hickman | |
| 4,873,049 A | | 10/1989 | Landwehr et al. | |
| 5,090,669 A | * | 2/1992 | Pieroni | A41H 15/00 269/54.5 |
| 5,575,206 A | | 11/1996 | Szyszko | |
| 6,533,885 B2 | | 3/2003 | Davis et al. | |

(Continued)

FOREIGN PATENT DOCUMENTS

| | | |
|---|---|---|
| GB | 1335190 A | 10/1973 |
| GB | 1401001 A | 7/1975 |

(Continued)

OTHER PUBLICATIONS

International Search Report and Written Opinion for PCT/US2017/059921, dated Apr. 25, 2018, 17 pages.

(Continued)

*Primary Examiner* — Orlando E Aviles
*Assistant Examiner* — Aaron R McConnell
(74) *Attorney, Agent, or Firm* — Brinks Gilson & Lione

(57) ABSTRACT

An adjustable jig for securing a textile during assembly. The textile may be an upper of an article of footwear. The jig includes a plurality of plates displaceable in a first axis and/or second axis, each plate with one or more pin attachment sites. A template is placed on the jig and pins are placed into each plate to set the pin pattern. The template is removed and a textile is mounted to the jig using the pin pattern. The jig may be configured to accommodate different sizes and shapes of textiles, and is resistant to heating and mechanical forces.

21 Claims, 9 Drawing Sheets

(56) References Cited

U.S. PATENT DOCUMENTS

| | | | | |
|---|---|---|---|---|
| 8,393,028 | B2 | 3/2013 | Namkook et al. | |
| 8,540,502 | B2 | 9/2013 | Chen | |
| 8,701,733 | B2 | 4/2014 | Leedy | |
| 8,784,939 | B2 | 7/2014 | Romero et al. | |
| 8,839,532 | B2 | 9/2014 | Huffa et al. | |
| 8,850,678 | B2 | 10/2014 | Crisp et al. | |
| 9,095,191 | B2 | 8/2015 | Liebeno | |
| 9,227,391 | B2 | 1/2016 | Baggen et al. | |
| 9,283,583 | B2 | 3/2016 | Regan et al. | |
| 9,320,312 | B2 | 4/2016 | Lyttle et al. | |
| 9,339,076 | B2 | 5/2016 | Droege et al. | |
| 2005/0055850 | A1 | 3/2005 | Ein-Gal | |
| 2011/0088282 | A1 | 4/2011 | Dojan et al. | |
| 2013/0125319 | A1* | 5/2013 | Regan ..... | A43D 11/00 12/142 R |
| 2016/0075128 | A1 | 3/2016 | Baggen et al. | |

FOREIGN PATENT DOCUMENTS

| | | | |
|---|---|---|---|
| WO | WO 2004/101229 | A1 | 11/2004 |
| WO | WO 2015/109320 | A1 | 7/2015 |

OTHER PUBLICATIONS

Hollingum, J., "Quick-change automation for shoe manufacture," *Assembly Automation,* 16(3):34-39 (1996), retrieved from http://dialog.proquest.com/professional/docview/212608335?accountid=157282.

Spencer, James E., "Robotics technology and the advent of agile manufacturing systems in the footwear industry," *Assembly Automation,* 16(3):10-15 (1996), retrieved from http://dialog.proquest.com/professional/docview/212608012?accountid=157282.

Wittenberg, G., "Automation in the footwear industry," *Assembly Automation,* 13(3):14 (1993), retrieved from http://dialog.proquest.com/professional/docview/212601810?accountid=157282.

International Preliminary Report on Patentability for PCT/US2017/059921, dated May 28, 2019, 10 pages.

Extended European Search Report for EP 19180047.3, dated Oct. 2, 2019, 9 pages.

* cited by examiner

ADJUSTABLE JIG

BACKGROUND

Textile manufacturing often involves production of an initial fabric, followed by various processing steps before final assembly. For example, uppers for an article of footwear may be manufactured by knitting, weaving or other methods, then processed by heating, pressing, or attaching components (e.g., laces, cables).

To facilitate processing, textiles are commonly mounted on securing plates (jigs). A fixed pattern of pins on the jig may be aligned with preset apertures in the textile to assist mounting. Conventional jigs generally only accommodate a single size of textile, however, making it necessary to use a different jig for different sizes and shapes of textiles. Moreover, conventional jigs may not withstand repeated heating and handling, requiring frequent replacement. These limitations increase labor time and costs, while reducing manufacturing efficiency.

SUMMARY

In one aspect, an adjustable jig is disclosed for securing a textile. The adjustable jig includes a frame; a first axis and a second axis, the first axis substantially perpendicular to the second axis; a plurality of plates within the frame, each having one or more pin attachment sites, each of the plurality of plates displaceable in a direction substantially perpendicular to the first axis; and means for securing the plates.

In embodiments, the textile is an upper for an article of footwear.

In embodiments, the means for securing the plurality of plates includes one or more guide rods disposed substantially parallel to the first axis and passing through openings in each of the plurality of plates, the guide rods configured to limit displacement of the plurality of plates in the first axis and/or second axis.

In one aspect, a securing assembly is disclosed for alternately securing a first textile and a second textile, including a frame; a first axis and a second axis, the first axis substantially perpendicular to the second axis; a plurality of plates, each of the plurality of plates having at least one pin attachment site, and each of the plurality of plates displaceable in a direction substantially perpendicular to the first axis; a first pin removably attached to a first pin attachment site, wherein the first pin in a first pin attachment site is configured to secure a first textile to the securing assembly and the first pin in a second pin attachment site is configured to secure a second textile to the securing assembly; and means for securing the plurality of plates in the first axis and/or second axis.

In one aspect, a method is disclosed for securing a textile, including overlaying a pin pattern template on an adjustable jig, the pin pattern template having a plurality of pin indicator sites, the adjustable jig having a frame; a first axis and a second axis, the first axis substantially perpendicular to the second axis; a plurality of plates disposed within the frame, each of the plurality of plates with one or more pin attachment sites; and means for securing the plurality of plates in the first axis and/or second axis.

In some embodiments, the method includes the steps of attaching a plurality of pins to one or more of the plates; independently moving one or more of the plates until each of the pins are disposed substantially at a pin indicator site, to define a pin pattern; securing the plurality of plates in the first axis and/or second axis; and attaching the textile to the adjustable jig using the pins.

BRIEF DESCRIPTION OF THE DRAWINGS

The following drawings are provided to illustrate various embodiments of the disclosure and are not intended to limit the scope of the invention. The components in the Figures are not necessarily drawn to scale. Like reference numerals in the drawings designate corresponding parts throughout the different views.

DETAILED DESCRIPTION

Figure 1:
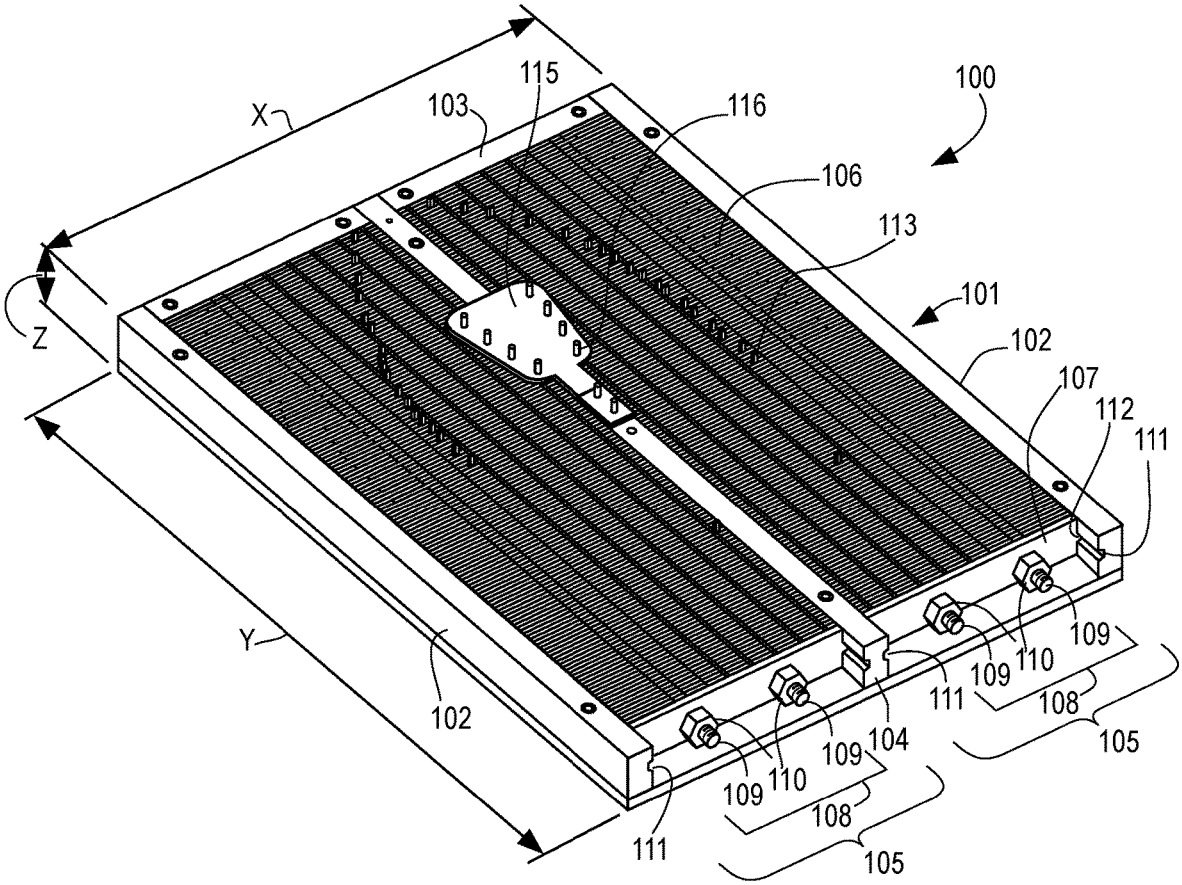
FIG. 1 is a perspective view of an embodiment of an adjustable jig, with pins attached.

Various aspects of the disclosure may be better understood by reference to the following detailed description. It is understood that features specifically described in the context of particular embodiments herein may also be implemented with other embodiments disclosed herein or other embodiments that may be reasonably anticipated by a person of skill in the art, within the scope and spirit of the disclosure.

Disclosed herein is an adjustable jig that may be configured to secure textiles having multiple sizes and/or shapes. The disclosed adjustable jig has a rugged, wear-resistant construction that facilitates repeated and prolonged use. One of the disclosed adjustable jigs may replace multiple conventional jigs that are configured for use with only one textile, reducing costs and increasing manufacturing efficiency.

As used herein, the term "jig" refers to a device that can be configured to temporarily but stably secure, mount, attach, or otherwise affix a textile to facilitate processing of that textile. As such, a "jig" may also be referred to as a "securing assembly", "securing plate", "mounting assembly", or the like. For example, the disclosed jig may be used to secure an upper of an article of footwear, allowing an operator to perform various operations on the secured upper before final assembly of the shoe.

In some embodiments, the disclosed adjustable jig is configured to secure multiple sizes and/or shapes of upper. For example, a single disclosed adjustable jig may be configured to secure uppers ranging from size 3 to size 13 or higher.

One or more post-production steps may be applied to a textile, such as an upper, when secured to the disclosed jig, including heating, steaming, pressing, printing, embroidering, chemical application, attaching various components (e.g., cables, laces, indicators), or other manipulations. For example, an upper may be steamed to alter physical characteristics of some portions of the upper (e.g., to fuse fusible materials), to relax the yarns in the upper, or to smooth portions of the upper. Similarly, an article of apparel may be embroidered, steamed, or otherwise manipulated on the jig.

Jigs may be formed using metal (e.g. aluminum or other alloys), plastic or other polymeric materials, wood, composite materials, or any material or collection of materials suitable for the purposes disclosed herein.

The term "adjustable jig" refers herein to a jig that can be configured to secure a first textile and subsequently reconfigured to secure a second textile of a different size, shape, or type. The term "adjustable" in "adjustable jig" is thus understood to refer to the ability of the disclosed adjustable jig to be reconfigured for use with multiple textiles. For example, in some embodiments, an adjustable jig may be configured to fit multiple sizes of uppers for an article of footwear. This is particularly important in the context of footwear and apparel, where styles may change yearly. The term "adjustable jig" may be used interchangeably with the term "universal jig" or the like.

Thus, in one aspect, an adjustable jig is disclosed for securing a textile. The adjustable jig includes a frame; a first axis and a second axis, the first axis substantially perpendicular to the second axis.

As used herein, the terms "textile" or "textile component" include, for example, woven, nonwoven, and knitted fabrics or cloth. The textiles for use with certain embodiments herein include articles, such as articles of footwear, including an upper or other portions of an article of footwear, articles of apparel, and other articles made using textiles. The article may be formed from one textile or multiple textiles.

For example, some uppers for articles of footwear are manufactured using a knitting process. Once a knitted upper is formed, further processing steps may take place depending upon the intended use of the knit upper. Thus, in particular embodiments, the disclosed adjustable jig is suitable for securing a knitted upper for processing. After processing, the upper may then be joined to other parts of the footwear.

In some cases, the upper is produced (as, for example, in a flat knitting or circular knitting process) as part of a continuous (e.g. single-piece) construct with a strobel, outsole and/or midsole and the construct is further manipulated before final assembly. In particular embodiments, the disclosed adjustable jig is thus useful for securing a single-piece construct including multiple portions of an article of footwear.

As used herein, the term "frame" may refer to a rigid or semirigid structure that surrounds or encloses other parts of the adjustable jig or that defines the boundaries of the adjustable jig. In some embodiments, the term "frame" may more generally refer to a base or backing for other parts of the disclosed adjustable jig. It is thus understood that in many cases, the shape and/or dimensions of the frame will substantially define the shape and/or dimensions of the adjustable jig itself.

It is also understood that the adjustable jig may include additional components, or that the adjustable jig may itself be associated with or part of another larger structure, but the frame generally defines the space containing the components of the adjustable jig involved in mounting the disclosed textiles.

The adjustable jig and/or frame may have any dimensions large enough to mount one or more textiles. In some embodiments, the adjustable jig and/or frame is substantially rectangular. In such cases, the length of the adjustable jig and/or frame may correspond to the "first axis" of the adjustable jig and/or frame, and the width of the adjustable jig and/or frame may correspond to the "second axis" of the adjustable jig and/or frame. In some embodiments, the adjustable jig and/or frame is substantially square, with the first axis approximately equal in length to the second axis. In addition to a first axis and a second axis, the disclosed jig and/or frame may have a depth or thickness.

The frame may be formed of any construction used to form the jig itself or any material or combination of materials suitable for the disclosed purposes.

In embodiments, the adjustable jig includes a plurality of plates disposed within the frame. As used herein, the term "plate" refers to a rigid or semirigid component within the adjustable jig. A plurality of plates may include, for example, 10-200 plates, preferably 50-150 plates, more preferably 100-150 plates. The plurality of plates may be located within the frame, as described herein.

The plurality of plates may form a stack of repeating elements within the frame. For example, a plurality of plates may form a horizontal stack with the plates substantially aligned with each other when a textile is not mounted on the jig.

The terms "preferred" and "preferably" herein refer to embodiments of the invention that may afford certain benefits, under certain circumstances. However, other embodiments may also be preferred, under the same or different circumstances. Furthermore, the recitation of one or more preferred embodiments does not imply that other embodiments are not useful and is not intended to exclude other embodiments from the scope of the present disclosure.

A plurality of plates will generally be used to define or "set" a pin pattern corresponding to a given textile, as discussed further herein. The location of apertures on a textile used to mount a textile to a jig may vary substantially between different pieces of textile. For example, an upper for a size 6 shoe, using conventional manufacturing practice, is likely to have a very different pattern of apertures than an upper for a size 10 shoe. To accommodate these differences, a large number of plates with significant freedom of movement (at least in one axis) increases the range and "resolution" of the jig, ensuring compatibility and adaptability with a wide range of textiles.

In embodiments, some or all of the plurality of plates are displaceable relative to the frame. In preferred embodiments, some or all of the plurality of plates are independently displaceable relative to the frame, such that displacement of one plate does not require or effect displacement of other plates. In other embodiments, displacement of one or more plates effects or is associated with displacement of other plates. For example, displacement of one plate may be associated with displacement of one or more immediately adjacent plates, such that a group of plates moves as a unit.

Displacement can be in any axis or direction. In some embodiments, one or more plates may be displaceable in a first axis, a second axis, or both a first and a second axis.

In certain embodiments, some or all of the plurality of plates are displaceable in a direction substantially perpendicular to the first axis of the frame. In specific embodiments, the plurality of plates are displaceable in the "x" axis (i.e., left and right, when viewed from above). In other embodiments, some or all of the plurality of plates are displaceable in a direction substantially perpendicular to the second axis of the frame.

In some embodiments, displacement of the disclosed plates is in a direction that is oblique to both a first axis and a second axis of the frame, as these terms are used hereinabove. For example, while a frame may have a substantially rectangular shape, one or more of the plurality of plates may be oriented and/or displaceable at an angle that is offset by about 5, 10, 15, 20, 25, 30, 35, 40, or 45 degrees with respect to the first axis or second axis.

Displacement of the disclosed plates may entail any process whereby the plates are moved in their position. In some embodiments, one or more plates are slidably displaceable. In such cases, the plates are configured to, or capable of, moving along a smooth surface (such as the base of the frame of the jig) while maintaining essentially continuous contact with that surface. In some embodiments, one or more plates are disposed and/or displaceable within grooves, tracks, or recesses. Such grooves, tracks, or recesses may help to define the position of the plates within the frame and/or the paths of travel of the plates when displaced.

In embodiments, the plates include one or more pin attachment sites. Any structure capable of receiving and at least temporarily securing a pin may be used. For example, the disclosed plates may include notches, recesses, apertures, magnetic attachments, slots, grooves, or any other suitable means for attaching a pin. In preferred embodiments, the one or more pin attachment sites are configured to reversibly attach a pin. In this way, an adjustable jig may be configured to secure a textile having one size or shape by "setting" a specific pattern of pins to the jig, then the pins may be removed and the jig reconfigured to a different textile having a different size or shape by setting a different pattern of pins.

In embodiments, the adjustable jig includes one or a plurality of pins attached to the one or more pin attachment sites.

As used herein, a "pin" refers to any of various implements that are generally thin and may have a narrowed, tapered, or sharpened tip at one or both ends. In some cases, a pin may be cylindrical or peg-shaped, with or without a narrowed, tapered, or sharpened tip. Pins may be used especially for fastening pieces of cloth, such as for securing a textile to the provided jig. Pins may be metal, plastic, or other rigid or semi-rigid material suitable for the purposes outlined herein. For example, injection-molded plastic may be a suitable material for pins in certain applications.

It is understood that a plurality of pins will generally be required to effectively secure a textile using the disclosed adjustable jig. As used herein, the term "pin pattern" may refer to this specific pattern of pins corresponding to a given textile. For example, a pin pattern for a size 5 upper may entail setting a pin pattern containing 20-50 pins, to allow sufficient specificity for that upper and to create enough points of attachment to effectively secure the upper to the jig for later processing. A pin pattern for a larger upper may require a pin pattern with more pins, because of the additional material. It is understood that a smaller number of pins may be set in a given pin pattern when the type of processing and manipulation is expected to be less vigorous, and a larger number of pins may be suitable when processing is expected to be more vigorous. Thus, an operator may choose not to set all pins corresponding to a given pin pattern.

Once attached at a pin attachment site, pins are expected to be relatively stable, to facilitate subsequent mounting and manipulation of a textile on the jig. However, in embodiments, pins are also configured to detach, as desired by an operator.

In some embodiments, the adjustable jig includes a means for securing the plates in the first axis and/or second axis. In certain embodiments, the means for securing applies tension in the first axis, the second axis, or both the first and the second axis. This tension may serve to effectively "set" the pin pattern corresponding to a given desired textile by "locking" the plates (and thus the pin pattern) in place under tension. In certain embodiments, a means for securing the plurality of plates may thus reduce, limit, restrict, or entirely prevent displacement of one or more plates in one or more axis.

The means for securing may include any component or system of components suitable for decreasing the ability of the plates to move, for example, by increasing tension or force applied to the plates, or physically locking individual plates in place. Examples of means for securing include, but are not limited to rods, screws, toggles, bolts, clamps, springs, lock pins, pegs, combinations thereof, and their equivalents. Preferably, the means for securing is reversible, such that the securing action can be relieved to allow displacement and repositioning of the plates when the disclosed jig is reconfigured for use with a different textile.

In one exemplary embodiment, a means for securing includes one or more guide rods disposed substantially parallel to the first axis and passing through openings in each of the plurality of plates. The guide rods, working with nuts, clamps, or other tightening devices, may be configured to limit displacement of the plurality of plates by applying tension in the first axis and/or second axis. In embodiments, 1, 2, 3, 4, 5, 6, 7, or 8, preferably 2-4, guide rods apply tension to the plurality of plates. A larger number of guide rods may help distribute tension more evenly along the plurality of plates. The guide rods may be threaded on at least one end. The means for securing may be controlled manually or by computer or other non-human controllers optimized to apply appropriate tension. As described, a means for securing may thus secure the plurality of plates collectively as, for example, by applying tension to the entire stack of plates.

The goal of securing one or more of the plurality of plates, particularly plates with one or more pins attached, may also be met in ways that do not involve tensioning. For example, in some embodiments, one or more of the plurality of plates includes a lock pin. As used herein, a lock pin refers to a device configured to mechanically prevent movement of one or more plates. For example, a lock pin may be engaged by springs or manual operation to drop into a recess in the frame (e.g., in the base of the frame), thus "locking" that plate and preventing further displacement. The person of skill in the art will understand that any other mechanism for limiting or preventing displacement of the plates after setting the position of the pins and plates may be employed, within the scope of the invention.

It is also understood that it may not be necessary to limit or prevent displacement of all the plates in a disclosed jig. Instead, only those plates bearing pins that form part of a pin pattern for mounting a given textile may need to be "locked." The remainder of the plates, which do not bear pins, may not require any such locking.

Thus, in a specific embodiment, an adjustable jig for securing a textile is disclosed, the adjustable jig including a frame having a first axis and a second axis, the first axis substantially perpendicular to the second axis; a plurality of plates disposed within the frame, each of the plurality of plates comprising one or more pin attachment sites for securing a textile to the jig, each of the plurality of plates displaceable in a direction substantially perpendicular to the first axis of the frame; and means for securing the plurality of plates in the first axis and the second axis.

In some embodiments, plates are separated from one another in the frame by open space. In such embodiments, the plates may, for example, be positioned in tracks, grooves, or recesses to maintain their position at least in one axis. In some embodiments, plates are separated by dividers. Dividers may be fixed with respect to the frame or non-fixed. Dividers may be formed of metal, wood, plastic or other polymeric materials, or any composites suitable for the disclosed purposes, and may have dimensions similar to plates, they may be thinner or thicker than plates, consistent with their purpose to separate adjacent plates. Dividers may be generally rigid or semi-rigid. Dividers may be coated or otherwise modified to promote free movement of the plates across their face and/or to reduce friction as the plates displace. A divider may also separate a plate from the frame or from an end plate. Dividers may or may not be displaceable in a first axis or second axis.

In some embodiments, no additional element separates plates in the adjustable jig from one another. Instead, adjacent plates partially or entirely abut along one or both sides of each plate. Plates may be coated or otherwise modified to promote free movement of the plates across one another or other component of the jig and to reduce friction as the plates displace.

In some embodiments, the adjustable jig or the frame is separated between a left compartment and a right compartment. In this context, the term "compartment" may be interchangeable with the terms "chamber", "section", "area", "side" or the like. A wall may be present in the jig and/or frame to demarcate a left compartment and a right compartment, with each of the left compartment and the right compartment including a plurality of plates. For example, where a jig and/or frame has a substantially rectangular shape, a wall of any suitable rigid or semi-rigid material (metal, plastic, etc.) may run longitudinally along a midline axis of the jig and/or frame to separate the jig and/or frame into a left and right chamber. Plates in the left compartment may thus be displaceable independently from plates in the right compartment, due to this wall.

In one aspect, a securing assembly is disclosed for alternately securing a first textile and a second textile. As used herein, the term "alternately" indicates that a disclosed securing assembly may be configured to secure a first textile, then reconfigured to secure a second textile. It is understood that a first textile may have a different shape, size, or other properties to a second textile. Alternatively, a first textile may have different means of attachment to the disclosed securing assembly to a second textile, such as a different pattern of apertures for mounting to the securing assembly, but not necessarily have a different shape, size, or other properties to a second textile.

In embodiments, the securing assembly has a first axis and a second axis, the first axis substantially perpendicular to the second axis. In some embodiments, each of the plurality of plates is displaceable in a direction substantially perpendicular to the first axis. In some embodiments, the securing assembly includes a plurality of plates, each of the plurality of plates having at least one pin attachment site.

In some embodiments, the securing assembly includes a first pin removably attached to a first pin attachment site, with the first pin in a first pin attachment site configured to secure a first textile to the securing assembly, and the first pin in a second pin attachment site configured to secure a second textile to the securing assembly. A first pin attachment site on a given plate may correspond to the position of an aperture on a first textile, when the first textile is subsequently mounted to the securing assembly, as described further herein. A first pin in a second pin attachment site may similarly correspond to the position of an aperture on a second textile, when the second textile is subsequently mounted to the securing assembly. Thus, in some embodiments, a first pin attachment site and a second pin attachment site may help to define the pin pattern for a given textile.

It is understood that a given pin pattern may require a plurality of pins attached at a plurality of pin attachment sites. Thus, in some embodiments, the securing assembly further includes a second pin removably attached to a second pin attachment site, wherein the second pin in the second pin attachment site is configured to secure the first textile to the securing assembly; and wherein the second pin in the second pin attachment site is configured to secure the second textile to the securing assembly.

In a similar manner, in certain embodiments, the securing assembly includes a third pin, a fourth pin, a fifth pin, a sixth pin, a seventh pin, an eighth pin, a ninth pin, a tenth pin, an eleventh pin, a twelfth pin, a thirteen pin, a fourteenth pin, a fifteenth pin, a sixteenth pin, a seventeenth pin, an eighteenth pin, a nineteenth pin, a twentieth pin, or any number of pins suitable for securing a given textile. Similarly, in certain embodiments, the securing assembly includes a third pin attachment site, a fourth pin attachment site, a fifth pin attachment site, a sixth pin attachment site, a seventh pin attachment site, an eighth pin attachment site, a ninth pin attachment site, a tenth pin attachment site, an eleventh pin attachment site, a twelfth pin attachment site, a thirteen pin attachment site, a fourteenth pin attachment site, a fifteenth pin attachment site, a sixteenth pin attachment site, a seventeenth pin attachment site, an eighteenth pin attachment site, a nineteenth pin attachment site, a twentieth pin attachment site, or any number of pin attachment site suitable for securing a given textile.

In embodiments, the securing assembly further includes a means for securing the plurality of plates in the first axis and/or the second axis. In some embodiments, the means for securing includes one or more guide rods disposed substantially parallel to the first axis of the frame and passing through openings in each of the plurality of plates, the guide rods configured to limit displacement of the plurality of plates in the first axis and/or second axis, as described previously herein.

In some embodiments, the plurality of plates are slidably displaceable in the first axis and/or second axis.

In some embodiments, a pin pattern template is disclosed. As used herein, the term "pin pattern template" refers to any design, pattern, outline, or the like that may be used to define and set a pattern of pins that correspond to apertures or other mounting structures on a corresponding textile. As discussed herein and understood in the art, many textiles are manufactured with holes, laces, loops, or other fastening means that allow the textile to be attached to a jig for further processing. It is not necessary that a pin pattern template define the location of 100% of these fastening means, within the scope of the present invention. Rather, a given pin pattern template must have sufficient correspondence to the pattern of such fastening means on a given textile that the pin pattern set by that pin pattern template can be used to effectively secure the textile, using the disclosed devices, systems, and/or methods. In embodiments, a pin pattern template will have one or more pin indicator sites to designate the position of each pin associated with a given pin pattern. In some embodiments, the pin indicator sites are selected from the group consisting of apertures, slots, grooves, recesses, openings, indentations, markings, and labels. Other means suitable for identifying the position on a pin pattern template corresponding to a given pin pattern may be envisioned by the person of skill in the art.

In one aspect, a system is disclosed for securing a textile, the system including a jig having a frame; a first axis and a second axis, the first axis substantially perpendicular to the second axis; a plurality of plates, each of the plurality of plates comprising one or more pin attachment sites for securing a textile to the jig, each of the plurality of plates displaceable in a direction substantially perpendicular to the first axis of the frame; means for securing the plurality of plates in the first axis and/or the second axis; a plurality of pins configured to attach to the one or more pin attachment sites; and a pin pattern template.

In some embodiments, the plurality of plates is disposed within the frame.

In some embodiments, the textile is an upper for an article of footwear.

In one aspect, a method is disclosed for securing a textile including the steps of overlaying a pin pattern template on an adjustable jig, the pin pattern template having a plurality of pin indicator sites, attaching a pin to one or more of the plates; independently moving one or more of the plates until each of the pins is disposed substantially at a pin indicator site, to define a pin pattern; securing the plurality of plates; and attaching the textile to the adjustable jig using the pins. In this manner, a pin pattern template may be used to define a pin pattern for a corresponding textile.

In embodiments, the adjustable jig includes a frame; a first axis and a second axis, the first axis substantially perpendicular to the second axis; a plurality of plates, each of the plurality of plates comprising one or more pin attachment sites for securing a textile to the jig, each of the plurality of plates displaceable in a direction substantially perpendicular to the first axis; and means for securing the plurality of plates in the first axis and the second axis.

In some embodiments, the plurality of plates is disposed within the frame.

In some embodiments, the plurality of plates are slidably displaceable in the first axis and/or second axis. In some embodiments, the plurality of pin indicator sites includes apertures within the pin pattern template.

In some embodiments, overlaying the pin pattern template to the jig includes aligning two or more guide pins on the jig with apertures on the pin pattern template.

In some embodiments, the means for securing includes one or more guide rods disposed substantially parallel to the first axis of the frame and passing through openings in each of the plurality of plates, the guide rods configured to limit displacement of the plurality of plates in the first axis and/or second axis. In particular embodiments, each of the one or more guide rods is threaded on at least one end.

In addition to the removably-fixed pins that may be attached to plates to set a pin pattern, as described herein, an adjustable jig may include one or more guide pins. As used herein, "a guide pin" may refer to a generally fixed pin mounted onto the frame or other portion of the jig to assist mounting and alignment of a textile. One or more guide pins may be disposed, for example, near a central axis of the frame. Further, the one or more guide pins may be configured to correspond to common apertures present in multiple textiles. For example, a guide pin along the centrally-disposed wall of the frame of an adjustable jig may be fixed and located in a position that is in common with several uppers. In the process of mounting an upper, an operator may begin by aligning one or more of these fixed guide pins with apertures in the upper, then mounting each of the remaining pins that have previously been "set" in various pin attachment sites on a plurality of plates.

The invention is further illustrated by reference to the following exemplary embodiments, which are provided to assist a clearer understanding of the invention, but are not intended to limit the scope of the invention.

Figure 2:
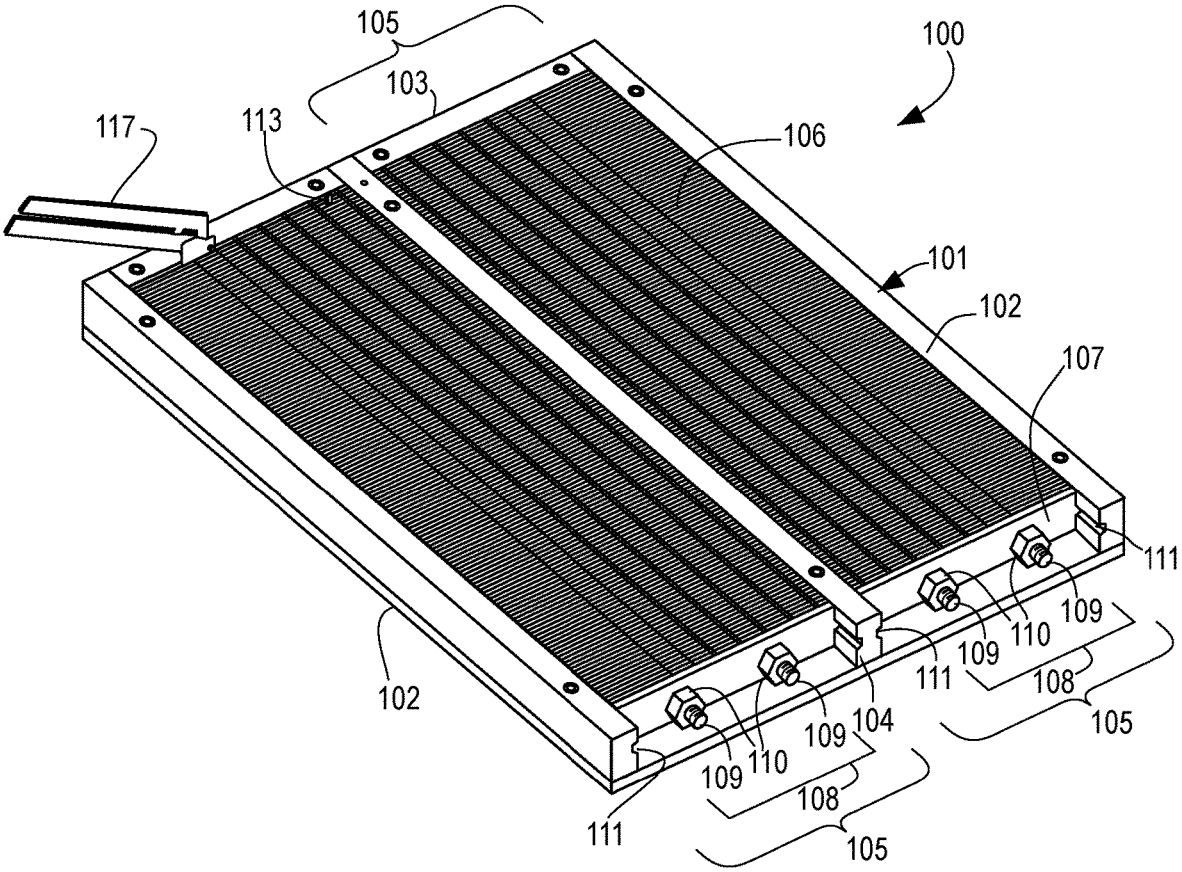
FIG. 2 is a perspective view of an embodiment of an adjustable jig and a plate tool.

Referring to FIGS. 1 and 2, adjustable jig 100 is provided including frame 101 constructed of metal (e.g., aluminum) or a combination of metal and plastic. Frame 101 as shown is substantially rectangular in shape, having width x, length y, and depth z. Thus, displacement parallel to the width may be described as displacement in the x axis, and displacement parallel to the length may be described as displacement in the y axis. Frame 101 further includes lateral walls 102, top wall 103, and center wall 104. Center wall 104 separates frame 101 into two compartments 105. Suitable dimensions for adjustable jig 100 will depend on the types of textiles being mounted, but exemplary dimensions may include x=400 mm; y=500 mm, and z=37 mm.

Each compartment 105 includes a plurality of plates 106, arranged in horizontal stacks, terminating on the near end of frame 101 by end plates 107.

Means for securing 108 are illustrated as including four guide rods 109 threaded on one end and fasteners 110 (e.g., bolts) visible on the near end of frame 101. Guide rods 109 are shown passing through end plates 107. Even distribution of guide rods 109 and attached fasteners 110 along end plates 107 helps distribute tension evenly along the plurality of plates 106 in frame 101 (i.e., along the "stack" of plates in the frame), thus securing plurality of plates 106.

Channels 111 in lateral walls 102 and center wall 104 are configured to receive extensions 112 of end plates 107. Plurality of plates 106 may similarly have extensions 112 (not shown) on their medial and lateral edges to aid their alignment in frame 101. Application of tension via means for securing 108 on plurality of plates 106, such as by tightening fasteners 110, displaces end plates 107 and plurality of plates 106 in a direction towards top wall 103. This tension limits or prevents displacement of plurality of plates 106 in the "x" direction and/or "y" direction of the adjustable jig, as viewed from above.

FIG. 1 further shows pins 113 attached to pin attachment sites 114 (not shown) on plurality of plates 106. As shown, approximately 38 of pins 113 define a pin pattern that may correspond to a particular textile, such as an upper or article of apparel. Further, eyelet plate 115 is shown attached to center wall 104. Unlike pins 113 that are removably attached to plurality of plates 106, eyelet plate 115 includes fixed pins 116. These fixed pins 116 may assist alignment of an eyelet portion and tongue (not shown) of an upper for an article of footwear. Eyelet plate 115, in some embodiments, is thus removably attached, as a unit, from frame 101, with its complement of fixed pins 116, when adjustable jig 100 is configured to secure particular uppers. As noted, in some embodiments herein, additional fixed pins 116 may be present on various other parts of frame 101, such as directly on lateral walls 102, top wall 103, or center wall 104, to serve as alignment aids for use with multiple textiles. In such cases, fixed pins 116 may be "universal" to a range of textiles intended for mounting on adjustable jig 100.

FIG. 2 further illustrates setting of pin 113 in one of the plurality of plates 106. As shown, plate tool 117 is used to grasp and displace one of the plurality of plates, after pin 113 is attached to pin attachment site 114.

Figure 3A:
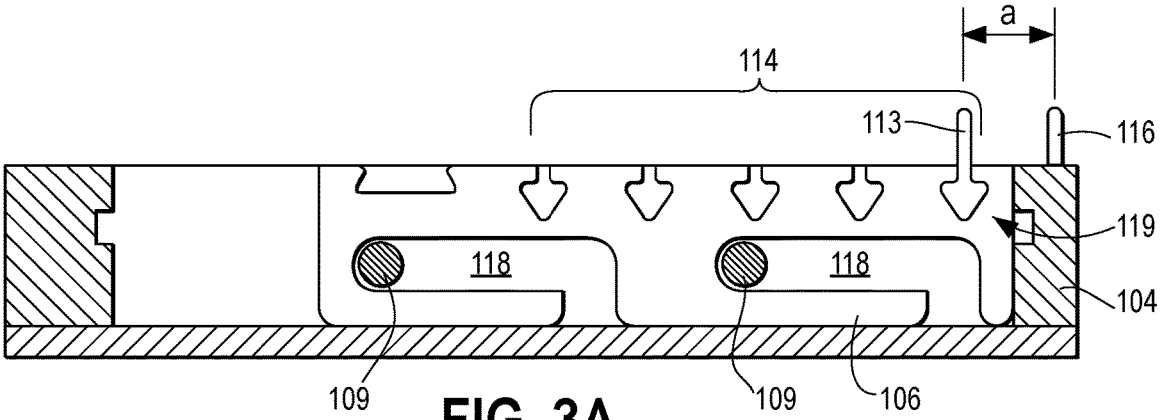
FIGS. 3A-3C are front views of an embodiment of a plate, pin attachment sites, and pin.
Figure 3B:
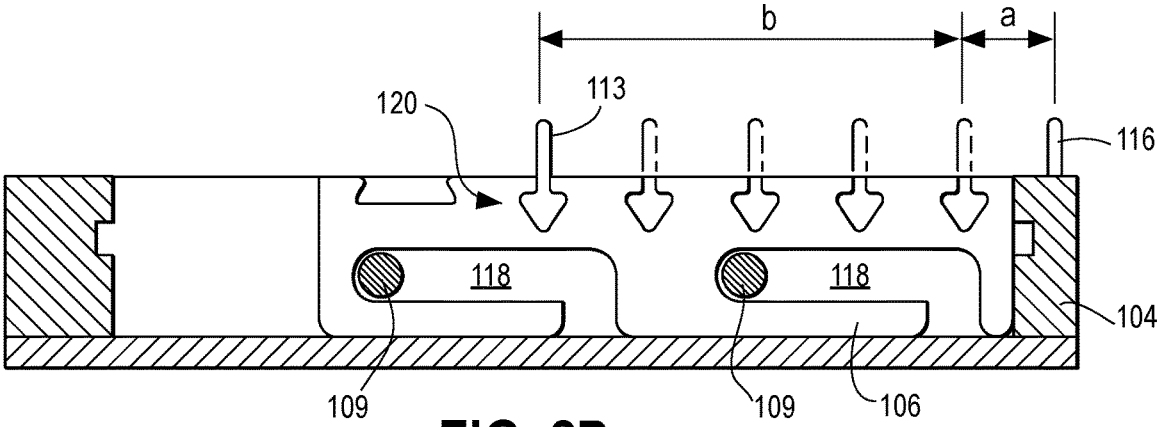
Figure 3C:
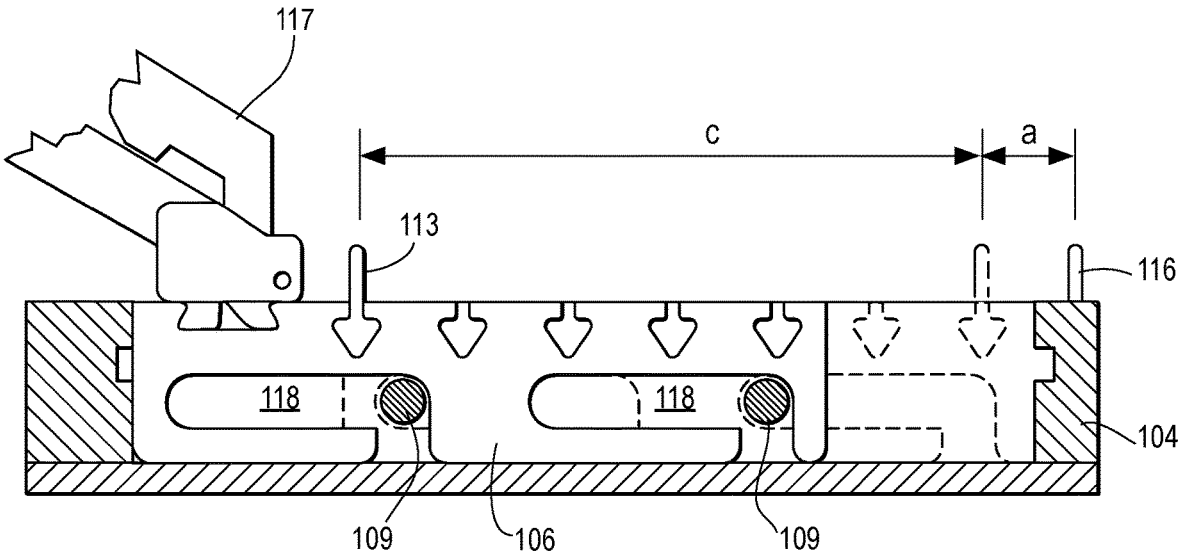

FIGS. 3A-3C illustrate one of plates 106. As shown, two guide rods 109 pass through openings 118 in plurality of plates 106. In these exemplary embodiments, openings 118 are shown as slots with an open end near the bottom of plate 106. This open end may facilitate the initial assembly of plurality of plates 106 within frame 101. A plurality of pin attachment sites 114 is further shown (see FIG. 3A). As shown, first pin attachment site 119 includes attached pin 113. In addition, fixed pin 116 is shown approximately centered on center wall 104.

As illustrated in FIG. 3A, "a" is the distance between fixed pin 116 and first pin attachment site 119. In some embodiments, distance "a" thus may define the narrowest possible position for pin 113 in a given pin pattern. It is understood that in most cases, a symmetrical or partly-symmetrical pattern of pins 113 will be set for the opposite (e.g., right) compartment.

In FIG. 3B, pin 113 is attached to a second pin attachment site 120, which in this embodiment is shown as farthest from fixed pin 116. As is apparent from the embodiment of FIG. 3B, multiple pin attachment sites 114 are available for attachment of pin 113. In some embodiments, distance "b" thus defines the range of possible distances of pin attachment sites 114 without displacing plate 106 itself. The ability of plate 106 to be displaceable in the "x" axis greatly expands the range of sizes and shapes of textile that can be mounted using a single adjustable jig 100.

FIG. 3C illustrates plate 106 after displacement in the "x" direction of frame 101. As shown, plate 106 has thus been displaced to the left using plate tool 117. Plate tool 117 is any tool suitable for grasping and pulling or pushing plate 106 in frame 101. Guide rods 109 are shown as displaced, relative to plate 106, to the opposite end of openings 118. Distance "c" thus defines the range over which pins 113 can be set on a given plate 106, relying on both the multiple pin attachment sites 114 and the ability to displace plate 106 itself. This "x" displacement of plate 106 thus greatly expands the range of locations for placement of pins 113, while also increasing the "resolution" of adjustable jig 100 to effectively mount textiles of various shapes and sizes. Although the number of possible pin attachment sites 114 on plate 106 is shown as discrete and limited in the exemplary figures, the ability of plate 106 to be displaceable allows a virtually continuous range of options for positioning any pin 113 in the x axis of frame 101.

Possible values for distances "a", "b", and "c" will vary depending on the types and sizes of textiles being mounted, but exemplary distances may be about a=18.3 mm, b=80.0 mm, and c=140.0 mm.

Figure 4:
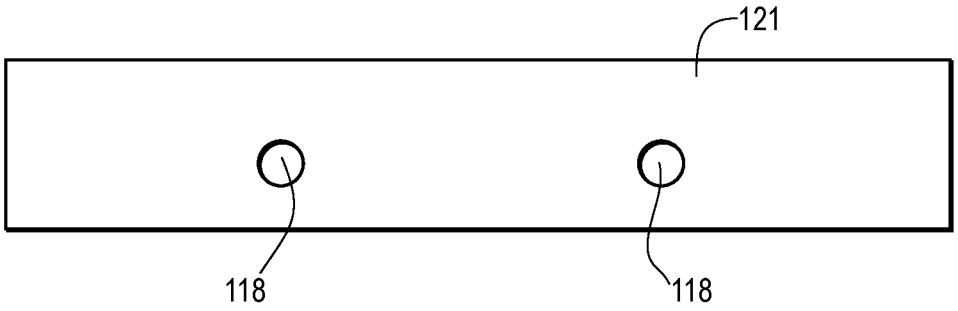
FIG. 4 is a front view of an embodiment of a divider.

FIG. 4 illustrates divider 121 that may be disposed between two plates 106, between plate 106 and a wall of frame 101, or between plate 106 and end plate 107, for example. Divider 121 helps to define spacing between multiple plates 106 and may facilitate displacement of plates 106, as discussed previously herein. Divider 121 as shown includes 2 openings 118 through which guide rods 109 may pass. In the exemplary embodiment of FIG. 4, openings 118 in divider 121 are not slotted, because the illustrated dividers are not intended to be displaceable in the "x" axis of frame 101.

Figure 5:
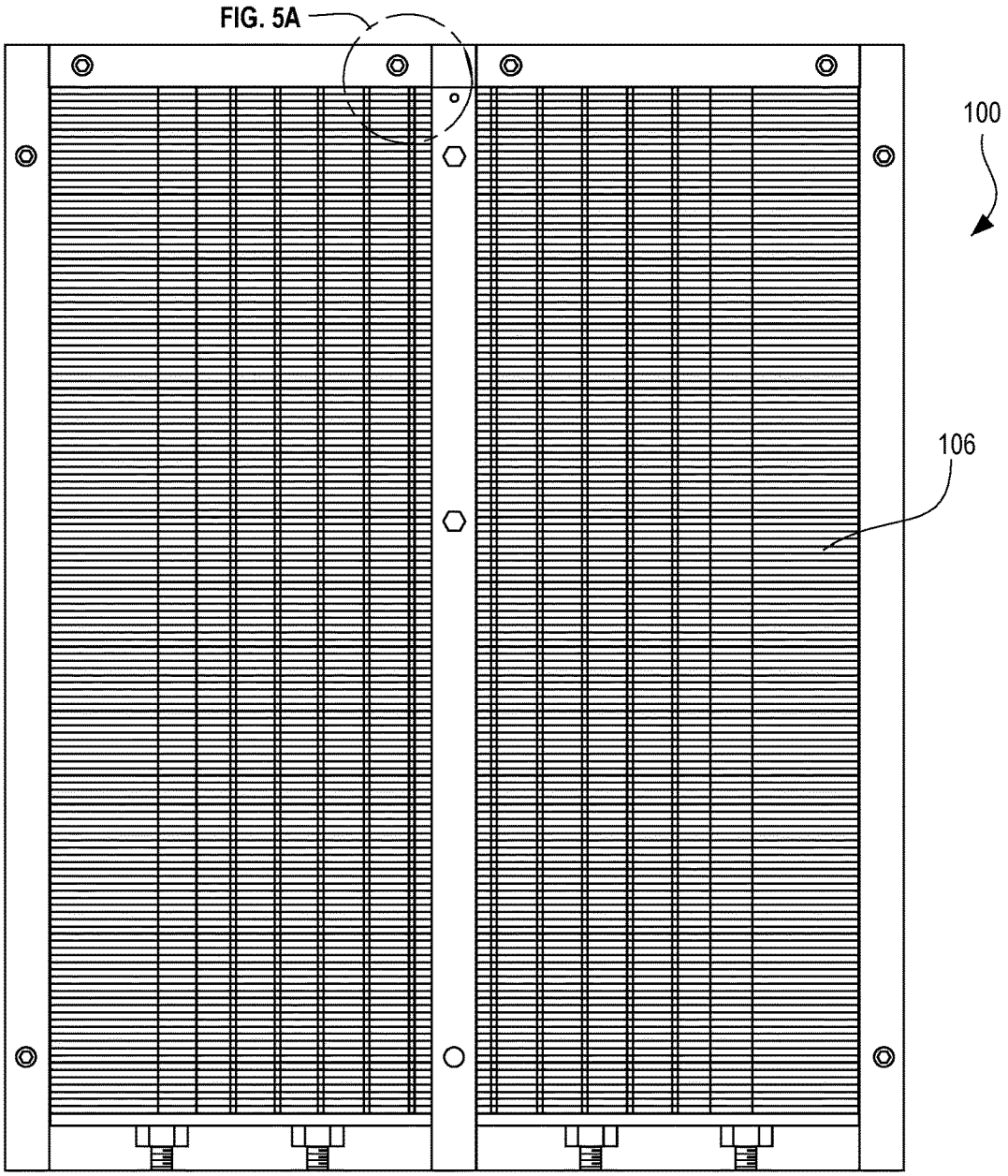
FIG. 5 is a top view of an embodiment of an adjustable jig.
Figure 5A:
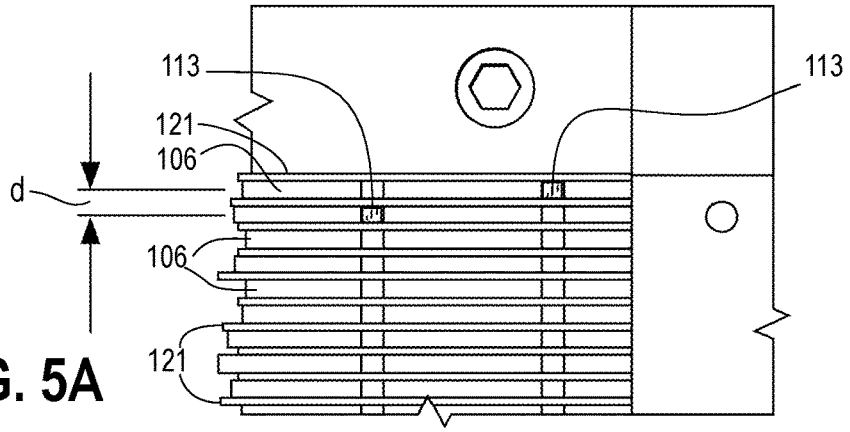
FIG. 5A is an expanded view of the adjustable jig of FIG. 5.

FIG. 5 shows another embodiment of adjustable jig 100, emphasizing plurality of plates 106. Referring to the expanded view of FIG. 5*a*, plates 106 are shown alternating with dividers 121. Two pins 113 are shown attached to two adjacent plates 106, which plates 106 are separated by divider 121. Distance "d" defines the distance between adjacent plates. In this exemplary embodiment, this distance may thus be described as the "y" distance between plates 106 and helps to define the resolution of adjustable jig 100 in the y direction. In this respect, a larger number of plates 106 and a smaller distance "d" between each plate may be associated with a higher resolution and more options for placing pins 113 to fit a range of sizes and shapes of textiles. In addition, in some embodiments, as tension is applied to plurality of plates 106 by means for securing 108, plurality of plates 106 may be displaced somewhat in this "y" direction (e.g., squeezed or shifted), introducing an additional source for tuning the position of pins 113 in pin pattern 122. Possible values for distances "d" (before tensioning) will vary depending on the types and sizes of textiles being mounted, but an exemplary distance may be about d=3.0 mm.

Figure 6B:
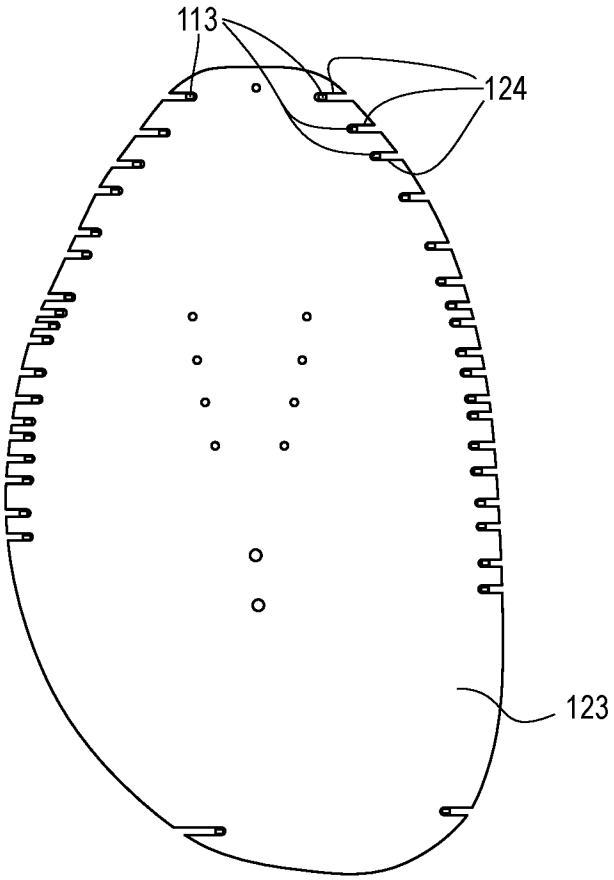
FIG. 6B is a top view of an embodiment of a pin pattern template for mounting an upper to an adjustable jig.
Figure 6A:
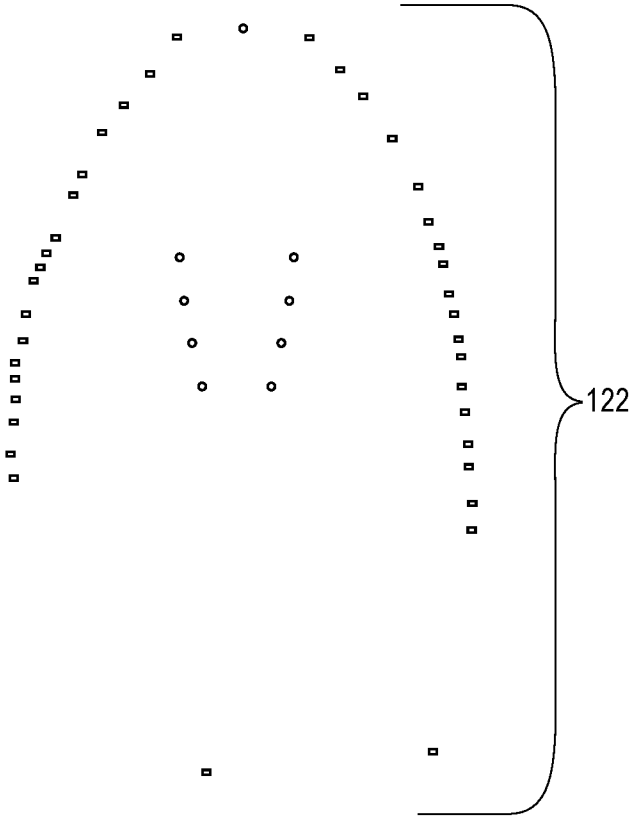
FIG. 6A is a top view of an embodiment of a pin pattern for mounting an upper to an adjustable jig.

FIG. 6A illustrates pin pattern 122 that corresponds to a given size and shape of textile. FIG. 6B illustrates pin pattern template 123 that may be used in conjunction with the methods disclosed herein to set pin pattern 122 of FIG. 6A using adjustable jig 100. FIG. 6B further illustrates pin indicator sites 124 within slots of pin pattern template 123, as discussed further below. It is understood that an almost unlimited number of pin pattern templates 123 may be used to set a correspondingly unlimited number of pin patterns 122.

Figure 7:
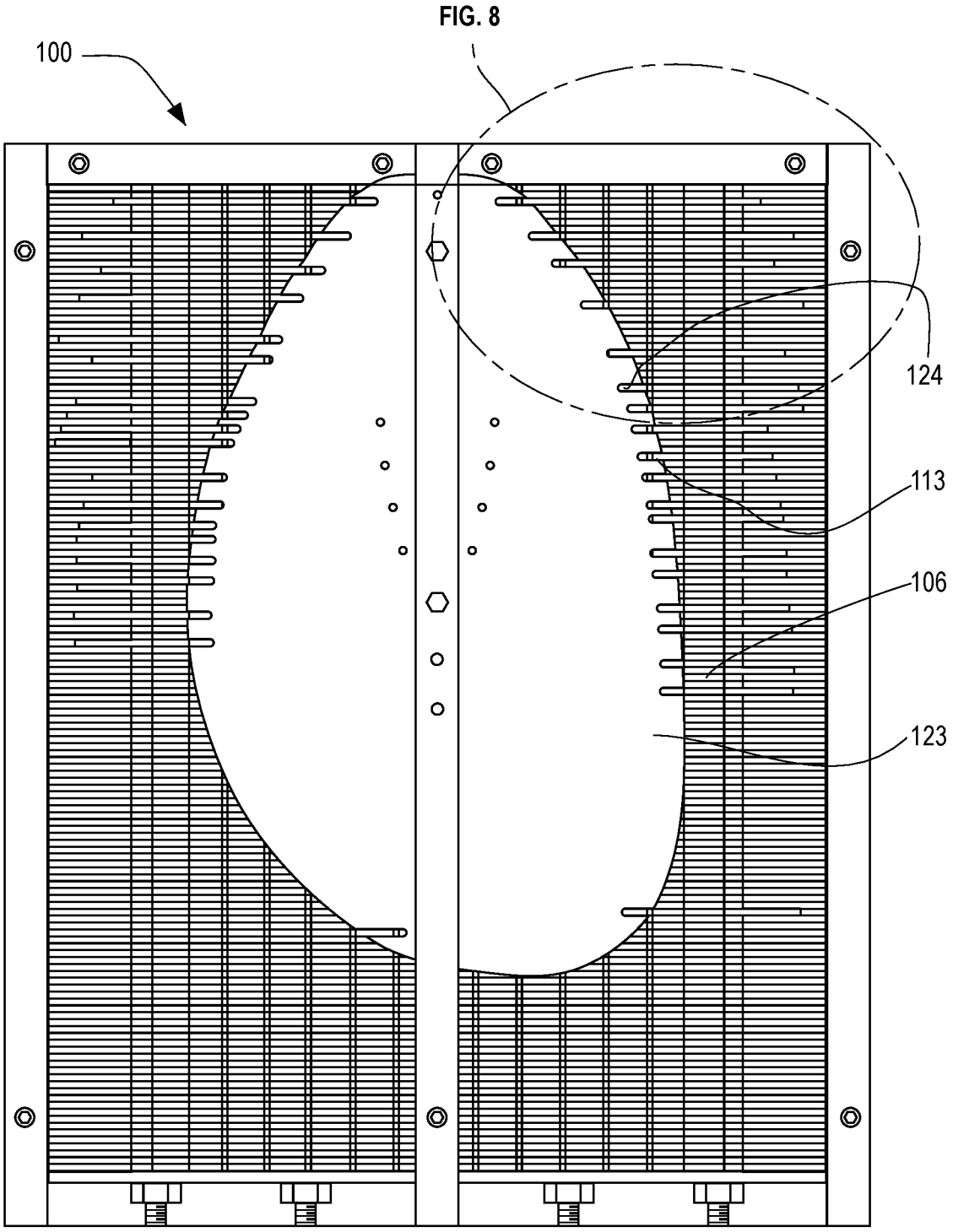
FIG. 7 shows a top view of an embodiment of an adjustable jig including a pin pattern template and a plurality of pins.
Figure 8:
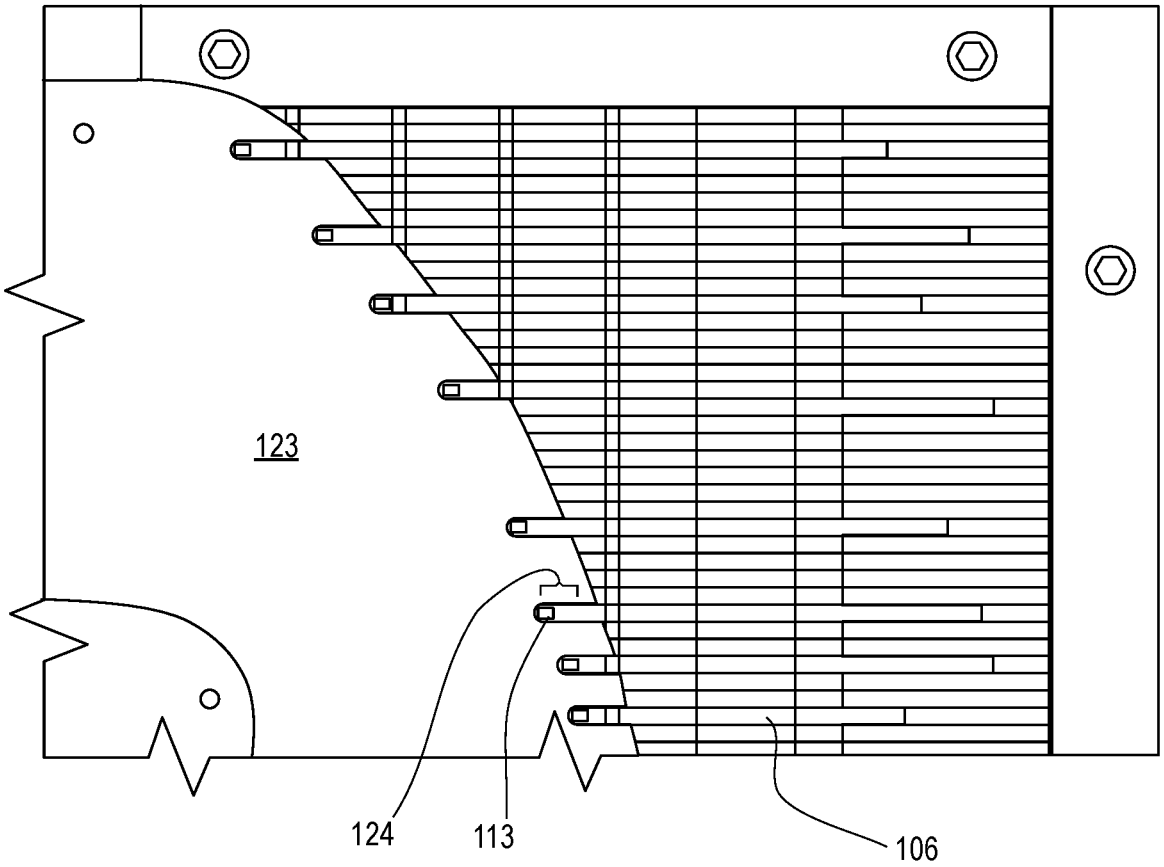
FIG. 8 is an expanded view of a portion of the adjustable jig of FIG. 7.

FIG. 7 further illustrates adjustable jig 100 with pin pattern template 123 attached. Several plates 106 are seen as displaced, such that pins 113 are generally engaged at pin indicator sites 124 within slotted portions of pin pattern template 123. In the expanded view illustrated in FIG. 8, each of plurality of plates 106 bearing pins 113 has been displaced in an "x" direction until each pin is located at pin indicator site 124 at the deepest margin of the slots. Plurality of plates 106 in adjustable jig 100 would then be "locked down" by means for securing 108, preventing further displacement of plates 106; pin pattern template 123 can then be removed; and the remaining (locked) pin pattern 122 used to attach a given textile to adjustable jig 100.

Figure 9:
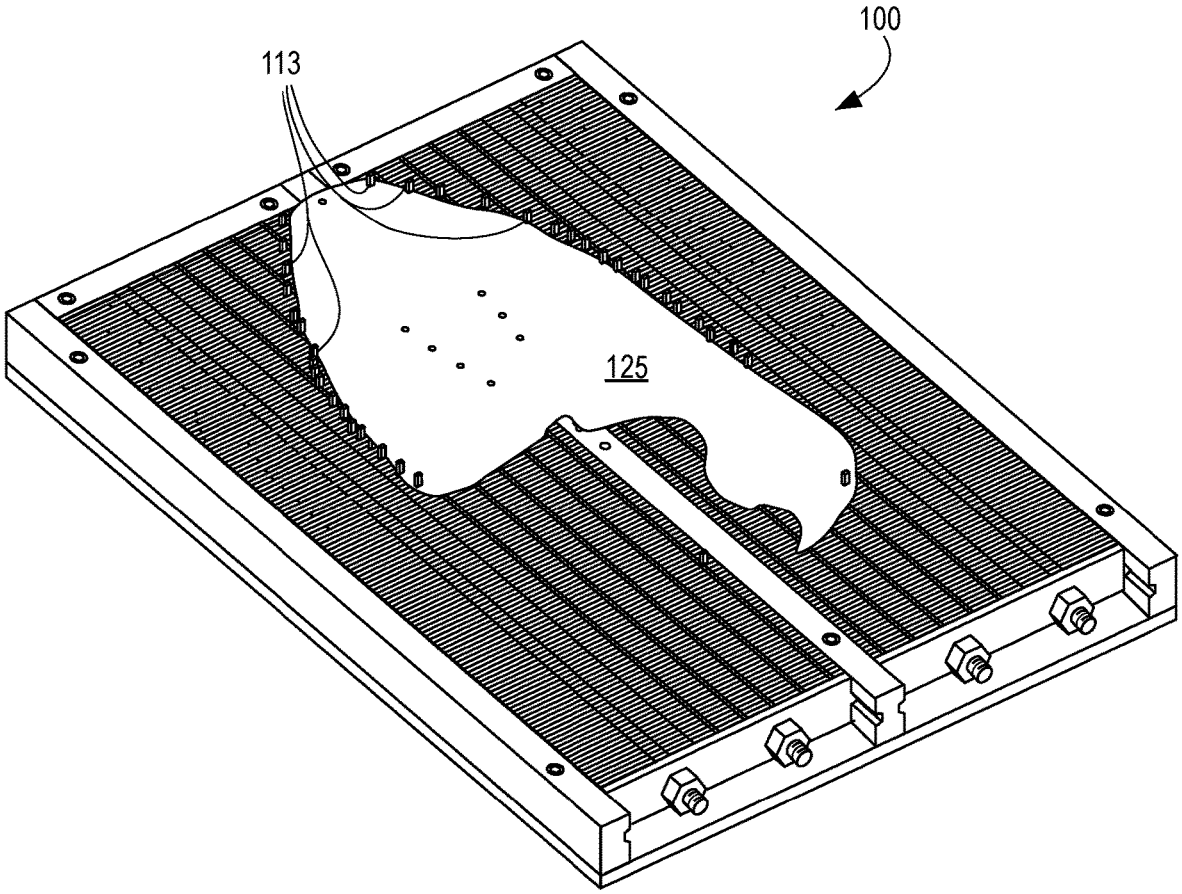
FIG. 9 is a perspective view of an embodiment of an adjustable jig including an upper for an article of footwear.

FIG. 9 illustrates adjustable jig 100 with textile 125. Textile 125 as shown is an upper. As illustrated, textile 125 is in the process of being mounted (i.e., being attached) to adjustable jig 100, using pins 113 of pin pattern 122 that was previously set by an operator according to methods disclosed herein. In the illustrated embodiment, not all pins 113 have been secured to corresponding apertures in textile 125.

While various embodiments have been described, the description is intended to be exemplary, rather than limiting, and it will be apparent to those of ordinary skill in the art that many more embodiments and applications are possible within the scope of the present disclosure. Accordingly, the disclosure is not to be restricted except in light of the attached claims and their equivalents. Also, various modifications and changes may be made within the scope of the attached claims.

What is claimed is:

1. An adjustable jig for securing a textile, the adjustable jig comprising: a frame; the frame comprising a first axis and a second axis, the first axis substantially perpendicular to the second axis; a plurality of displaceable plates, each of the plurality of displaceable plates comprising one or more pin attachment sites for securing the textile to the jig, each of the plurality of displaceable plates displaceable in a direction substantially perpendicular to the first axis; and at least one fixed plate, the fixed plate being fixed relative to the frame; and wherein the at least one fixed plate comprises at least one fixed pin.

2. The adjustable jig of claim 1, further comprising means for securing the plurality of plates in at least one of the first axis and the second axis, and wherein the means for securing the plurality of displaceable plates is configured to limit displacement of the plates in at least one of the first axis and the second axis.

3. The adjustable jig of claim 1, wherein the means for securing the plurality of displaceable plates comprises one or more guide rods disposed substantially parallel to the first axis and passing through openings in each of the plurality of displaceable plates, the guide rods configured to limit displacement of the plurality of plates in at least one of the first axis and the second axis.

4. The adjustable jig of claim 3, wherein each of the one or more guide rods is threaded on at least one end.

5. The adjustable jig of claim 1, wherein the plurality of displaceable plates are slidably displaceable in the second axis.

6. The adjustable jig of claim 1, further comprising a plurality of pins attached to the one or more pin attachment sites.

7. The adjustable jig of claim 1, further comprising at least one divider disposed between two adjacent plates of the plurality of plates, the divider fixed with respect to the frame.

8. The adjustable jig of claim 1, wherein the textile forms a portion of an article of apparel.

9. The adjustable jig of claim 1, wherein the textile forms a portion of an upper for an article of footwear.

10. The adjustable jig of claim 9, wherein the upper is a knitted upper.

11. The adjustable jig of claim 1 wherein at least one of the plurality of displaceable plates comprises more than two spaced apart pin attachment sites.

12. A securing assembly for alternately securing a first textile and a second textile, the securing assembly comprising: a frame; a first axis and a second axis, the first axis substantially perpendicular to the second axis; a plurality of displaceable plates, each of the plurality of displaceable plates having a plurality of pin attachment sites, wherein each of the plurality of displaceable plates are displaceable in a direction substantially perpendicular to the first axis; a first pin removably attached to at least one of the plurality of pin attachment sites, wherein the first pin in a first pin attachment site is configured to secure the first textile to the securing assembly and the first pin in a second pin attachment site is configured to secure the second textile to the securing assembly; at least one fixed plate, the fixed plate being fixed relative to the frame; and wherein the at least one fixed plate comprises at least one fixed pin.

13. The securing assembly of claim 12, further comprising a second pin removably attached to a pin attachment site, wherein the second pin in the first pin attachment site is configured to secure the first textile to the securing assembly; and wherein the second pin in the second pin attachment site is configured to secure the second textile to the securing assembly.

14. The securing assembly of claim 12, further comprising a means for securing the plurality of displaceable plates in the first axis and the second axis, wherein the means for securing the plurality of displaceable plates comprises one or more guide rods disposed substantially parallel to the first axis and passing through openings in each of the plurality of displaceable plates, the guide rods configured to limit displacement of the plurality of displaceable plates in at least one of the first axis and the second axis.

15. The securing assembly of claim 12, wherein the plurality of displaceable plates are slidably displaceable in the second axis.

16. A method of securing a textile, the method comprising: overlaying a pin pattern template on an adjustable jig, the pin pattern template having a plurality of pin indicator sites, the adjustable jig comprising: a frame; a first axis and a second axis, the first axis substantially perpendicular to the second axis; a plurality of displaceable plates disposed within the frame, each of the plurality of displaceable plates comprising one or more pin attachment sites for securing a textile to the jig, each of the plurality of displaceable plates displaceable in a direction substantially perpendicular to the first axis; at least one fixed plate, the fixed plate being fixed relative to the frame, wherein the at least one fixed plate comprises at least one fixed pin; attaching a pin to one or more of the displaceable plates; independently moving one or more of the displaceable plates until each of the pins is disposed substantially at a pin indicator site on the displaceable plates, to define a pin pattern; and attaching the textile to the adjustable jig using a pin on at least one of the displaceable plate and the fixed plate.

17. The method of claim 16, wherein the plurality of pin indicator sites on the displaceable plates comprise apertures within the pin pattern template.

18. The method of claim 16, wherein overlaying the pin pattern template to the jig comprises aligning two or more guide pins on the jig with apertures on the pin pattern template.

19. The method of claim 16, wherein a means for securing the plurality of displaceable plates comprises one or more guide rods disposed substantially parallel to the first axis and passing through openings in each of the plurality of displaceable plates, the guide rods configured to limit displacement of the plurality of displaceable plates in the first axis and/or second axis.

20. The method of claim 16, wherein each of the one or more guide rods is threaded on at least one end.

21. The method of claim 16, wherein the plurality of displaceable plates are slidably displaceable in the first axis and/or second axis.

* * * * *